US012662272B2

(12) United States Patent
Zanin

(10) Patent No.: US 12,662,272 B2
(45) Date of Patent: Jun. 23, 2026

(54) FOLDING UNIT FOR FOLDING A FILM MATERIAL TO FORM A TUBULAR WRAPPING

(71) Applicant: ILAPAK INTERNATIONAL S.A., Collina d'Oro (IT)

(72) Inventor: Alessandro Zanin, Collina d'Oro (IT)

(73) Assignee: ILAPAK INTERNATIONAL S.A., Collina d'Oro (IT)

( * ) Notice: Subject to any disclaimer, the term of this patent is extended or adjusted under 35 U.S.C. 154(b) by 817 days.

(21) Appl. No.: 18/011,619

(22) PCT Filed: Mar. 24, 2021

(86) PCT No.: PCT/IB2021/052417
§ 371 (c)(1),
(2) Date: Dec. 20, 2022

(87) PCT Pub. No.: WO2021/260445
PCT Pub. Date: Dec. 30, 2021

(65) Prior Publication Data

US 2023/0234735 A1 Jul. 27, 2023

(30) Foreign Application Priority Data

Jun. 22, 2020 (IT) ..... 102020000014857

(51) Int. Cl.
*B65B 9/06* (2012.01)
*B65B 9/067* (2012.01)
*B65B 9/10* (2006.01)

(52) U.S. Cl.
CPC ..... *B65B 9/06* (2013.01); *B65B 2009/063* (2013.01); *B65B 9/067* (2013.01); *B65B 9/10* (2013.01)

(58) Field of Classification Search
CPC .. B65B 9/06; B65B 9/067; B65B 9/10; B65B 9/20; B65B 9/207; B65B 9/22; B65B 2009/063
See application file for complete search history.

(56) References Cited

U.S. PATENT DOCUMENTS 2,602,276 A * 7/1952 Campbell ..... B65B 11/18 53/550
2,747,346 A * 5/1956 Tigerman ..... B65B 25/18 53/550

(Continued)

FOREIGN PATENT DOCUMENTS

DE 1586334 B1 3/1972
DE 4021934 A1 1/1992

(Continued)

*Primary Examiner* — Robert F Long
*Assistant Examiner* — Eduardo R Ferrero
(74) *Attorney, Agent, or Firm* — JCIPRNET

(57) ABSTRACT

A folding unit includes componentry for folding a continuous sheet of a film material fed along an infeeding direction, to form a tubular wrapping. The folding unit has a base structure, a first pair of folding plates and a second pair of folding plates. Folding edges of the plates of the first pair of folding plates form, with the base structure, a first angle, while folding edges of the plates of the second pair of plates form, with a longitudinal axis of the base structure, a second angle, where the first angle and the second angle differ from one another by ±2°.

11 Claims, 5 Drawing Sheets

(56) References Cited

U.S. PATENT DOCUMENTS 3,090,174 A * 5/1963 Kraft ..... B29C 66/8161 53/511
3,417,544 A * 12/1968 Grevich ..... B65B 9/06 53/550
3,511,024 A * 5/1970 Manspeaker ..... B65B 51/30 53/550
3,553,933 A * 1/1971 Seko ..... B65B 9/06 53/550
3,581,457 A * 6/1971 Gerlach ..... B65B 9/06 206/820
4,429,513 A * 2/1984 Beckers ..... B65B 25/005 53/550
4,464,883 A * 8/1984 Glover ..... B65B 23/10 53/550
4,587,794 A * 5/1986 Kopp ..... B65B 9/06 53/550
4,761,937 A 8/1988 Francioni
4,967,541 A * 11/1990 Lakey ..... B65B 9/067 53/553
5,255,495 A * 10/1993 Kovacs ..... B65B 59/001 53/550
5,408,806 A * 4/1995 Lin ..... B65B 9/06 53/550
5,564,261 A * 10/1996 Kiner ..... B65B 63/026 53/529
5,799,470 A * 9/1998 Sautter ..... B65B 9/06 53/550
5,987,860 A * 11/1999 Yang ..... B65B 9/067 53/550
9,038,355 B2 * 5/2015 Honegger ..... B65B 59/001 53/381.1
11,084,608 B2 * 8/2021 Newcombe ..... B65B 25/065
11,472,588 B2 * 10/2022 Li ..... B65B 41/16
2002/0189206 A1 * 12/2002 Capodieci ..... B65B 51/306 53/550
2003/0115839 A1 * 6/2003 Torre ..... B65B 9/067 53/550
2009/0229228 A1 * 9/2009 Sambugaro ..... B65G 21/12 53/550
2013/0097976 A1 * 4/2013 Honegger ..... B65B 59/001 53/381.1
2018/0118390 A1 * 5/2018 Mulder ..... B65B 31/04
2022/0194640 A1 * 6/2022 Drut ..... B65B 59/001
2023/0174332 A1 * 6/2023 Lopes ..... B65B 51/10 242/174

FOREIGN PATENT DOCUMENTS

EP 3988459 A1 * 4/2022 ..... B65B 59/003
EP 3728047 B1 * 5/2024 ..... B65B 9/06

* cited by examiner

FOLDING UNIT FOR FOLDING A FILM MATERIAL TO FORM A TUBULAR WRAPPING

FIELD OF THE INVENTION

The present invention relates to the technical sector concerning packaging of products internally of packaging material in the form of film which is wound about the products to form a packaging, known as flow pack packaging.

DESCRIPTION OF THE PRIOR ART

To realise the flow-packs, the film material, usually a continuous sheet made of a plastic material, or aluminium or the like, is unwound from a relative reel and advanced along an infeeding direction corresponding to the advancement direction of the products to be packaged.

During the infeeding along the infeeding direction the continuous sheet is subjected to various folding and forming steps to form a tubular wrapping about the products, which wrapping comprises an upper portion, two lateral portions, and two lower portions in which the end flaps are folded and facing one another in such a way as then to be reciprocally heat-welded.

The two open heads of the tubular wrapping, thus-formed, with the relative product inside (or a stack or series of products), will then be folded and sealed for the forming of the final packaging.

To realise the various folds in the continuous sheet, to form the tubular wrapping, as described in the foregoing, forming units are used, which are realised in such a way as to comprise a series of folding means of the sheet which are arranged in sequence one after another along the infeeding direction of the sheet and the advancement direction of the products.

The forming units must be predisposed to carry out a first folding of the continuous sheet in such a way as to define, in the continuous sheet which is advancing along the advancement direction, a central section and two lateral sections folded, for example upwards, with respect to the central section.

The central section will define the upper portion of the wrapping, while the two lateral sections will be folded several times so as to define the two lateral portions and the two lower portions with the relative end flaps folded and facing one another.

The folding of the continuous sheet, during the advancement of the continuous sheet along the infeeding direction, takes place at the same time as the advancement of the products to be packaged: the tubular wrapping is thus formed about the products while they are advancing along the advancement direction thereof.

A known folding unit is described in document IT 1208412.

The folding unit described in this document is used for folding continuous sheets, laminated or coupled, of film materials made of plastic or aluminium, which are unwound from a relative reel and advanced along an infeeding direction corresponding to the advancement direction of the products to be packaged.

This folding unit comprises first folding means, comprising a first pair of upper rollers, which fold the continuous sheet unwound from the reel of film material in such a way as to define a central section and two lateral sections folded upwards with respect to the central section, and also second folding means, comprising a second pair of lower rollers, arranged downstream of the first pair of upper folding rollers with respect to the infeeding direction of the continuous sheet, for folding the two lateral sections downwards, forming a sort of wrapping in an upturned U-shape.

The products to be packaged are moved inside the upturned U-shaped wrapping.

The central section of the thus-folded continuous sheet will be positioned above the products, forming the upper portion of the tubular wrapping, while the two lateral sections will be positioned at the flanks of the products, with the relative end parts with the end flaps projecting inferiorly of the products.

In the meantime the products are advanced along the advancement direction thereof in such a way as to insert in the upturned U-shaped wrapping.

In this regard, the folding unit comprises a base structure having a longitudinal slot, for passage of the drawing elements of the products, and which constitutes the rest and sliding base of the products, and a conveying channel, internally of which the products pass and about with the continuous sheet is folded for forming, first the upturned U-shaped wrapping, and then the final tubular wrapping.

The conveying channel usually comprises a pair of lateral walls, parallel to one another, and at least an upper wall.

In this way, the products are advanced along the base plate internally of the conveying channel, i.e. between the lateral walls of the conveying channel, while the continuous sheet is wound to form an upturned U-shape about the conveying channel.

The folding unit also has third folding means for folding the end parts of the two lateral sections of the continuous sheet which project inferiorly with respect to the products, tucking them below the products to form the lower portions of the tubular wrapping beneath the products.

Lastly, the folding unit has a profiled plate in the shape of an isosceles triangle which defines, with the edges of the relative two oblique sides, fourth folding means for folding the end flaps of the two lateral sections, in the meantime folded beneath the products by the third folding means, so that they are arranged facing one another to enable the mutual welding, by means of welding heads arranged downstream, to complete the tubular wrapping about the products.

A folding unit of this type has been shown to be quite effective for the realising of flow-packs using films constituted by continuous sheets made of plastic material, laminated, coupled or aluminium.

It has however not been demonstrated to be so reliable and effective, on the other hand, in the event that it desired to make flow-packs using film materials constituted by paper, single-layer materials, of a compostable or biodegradable type.

In fact, these types of materials, such as for example paper, which is non-extensible and more rigid with respect to plastic materials, are difficult to fold, especially as a high production speed is desired to be maintained.

It is in fact necessary to avoid the forming of wrinkles or the breakage of the material.

In the folding unit described in document IT1208412, the interaxis between the first pair of upper rollers and the second pair of lower rollers is slight and, although the height position of the first pair of upper rollers with respect to the second pair of lower rollers is adjustable; this does not enable, in the case of paper or single-layer materials, of bio-compostable or biodegradable type, preventing the occurrence of wrinkling during the folding, or even undesirable breakages of the material.

SUMMARY OF THE INVENTION

An object of the present invention is therefore to provide a novel folding unit, for folding a film material to form a tubular wrapping, which is effective and reliable even in the event of the use of paper materials, of bio-compostable or biodegradable type, as well as the classic plastic materials, single-layer, laminated or coupled, or aluminium, further enabling maintaining high production velocities.

The cited aim is attained by means of a folding unit according to the claims.

BRIEF DESCRIPTION OF THE DRAWINGS

The characteristics of a preferred, but not exclusive, embodiment of the folding unit of the invention will be described in the following description with reference to the appended tables of drawings, in which.

DESCRIPTION OF THE PREFERRED EMBODIMENTS

Figure 1:
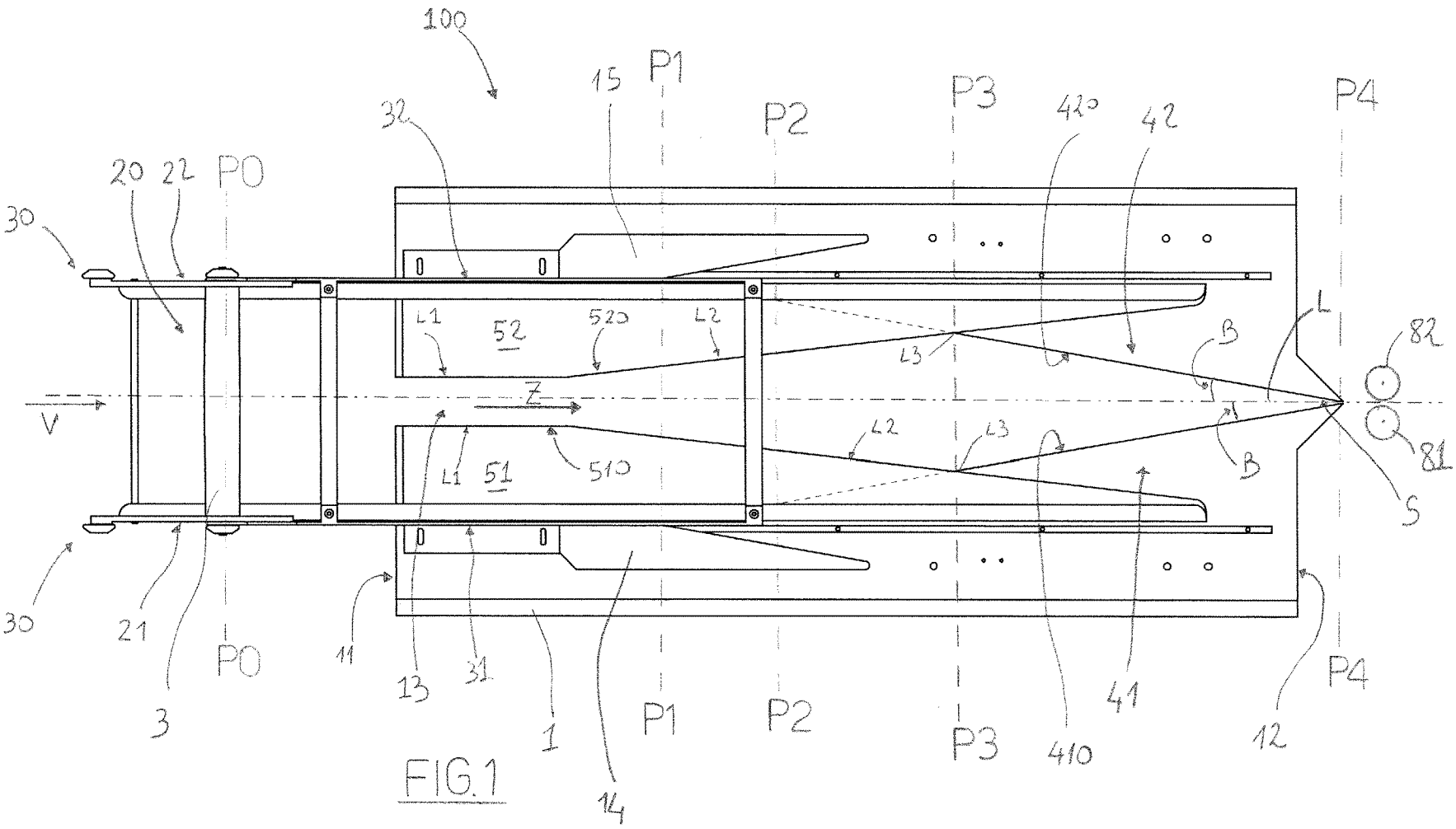
FIG. 1 schematically illustrates, in a plan view from above, the folding unit according to the invention; this figure also illustrates successive folding planes (P0, P1, P2; P3 P4) indicative of various positions along the folding unit at which the folding unit carries out successive folding operations on a continuous sheet of a film material (not illustrated in this figure), fed along an infeeding direction (Z) which crosses the folding unit, for realising a tubular wrapping about products (also not illustrated) in advancement along an advancement direction (V) coinciding with the infeeding direction (Z) of the film material.

With reference to the accompanying tables of drawings, reference numeral (100) denotes the folding unit of the present invention, for folding a film material (M) to form a tubular wrapping (T).

A continuous sheet (F) of the film material (M) is to be folded to form a tubular wrapping (T) while it is being fed according to an infeeding direction (Z), coinciding with the advancement direction (V) of products which are to be wrapped internally of the tubular wrapping (T) for realising final packages, known by the name of flow packs.

In the figures of the drawings, detailed illustrated is not given of the means for unwinding the continuous sheet (F) of the film material (M) from a relative reel, nor the means for infeeding the continuous sheet (F) along the infeeding direction (Z), as they are of known type and not directly relevant to the present invention; for the same reason the products to be packaged, nor the means used for advancing the products are not illustrated, as they do not constitute part of the invention.

For the sake of clarity, both the infeeding direction (Z), along which the continuous sheet (F) of the film material (M) which is to be folded to form a tubular wrapping (T) is supplied, and the advancement direction (V) of the products, are illustrated in an entirely schematic way.

Figure 2A:
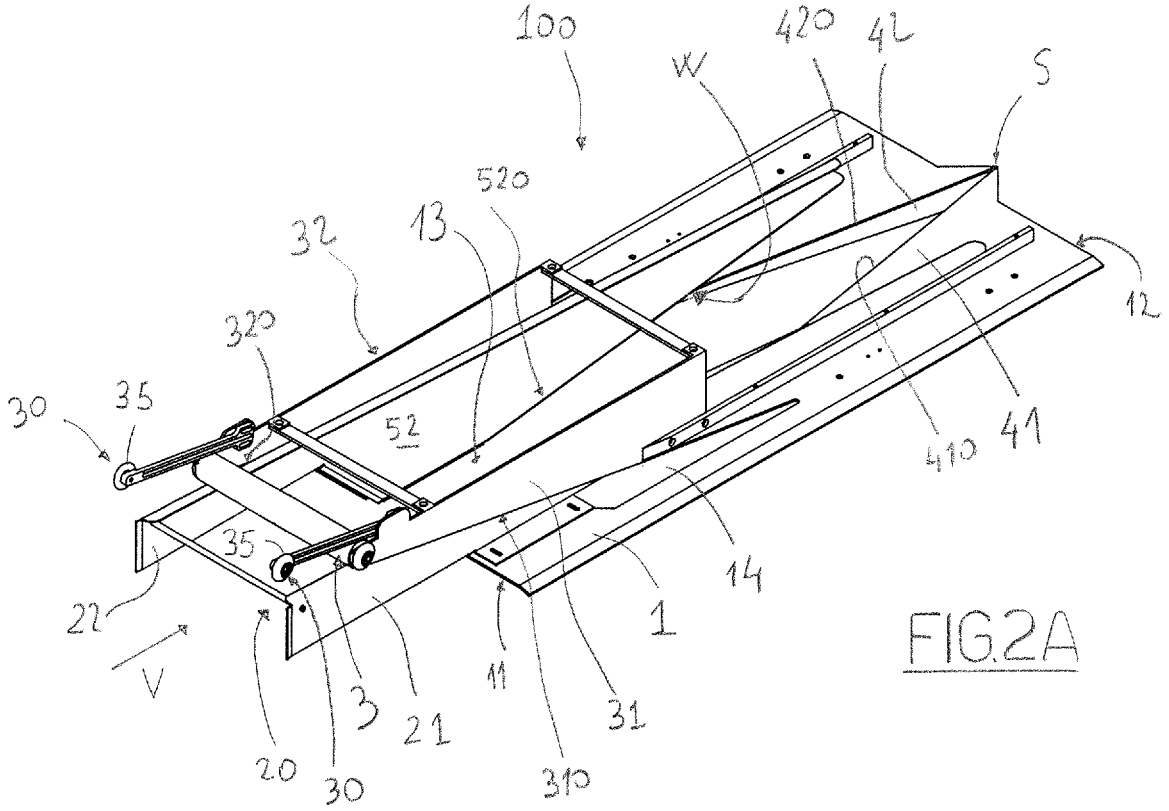
FIG. 2 illustrates the folding unit according to a schematic perspective view taken from a first angle, in which the forming unit is visible in an upper rear lateral view.
FIG. 2B illustrates the folding unit according to a schematic perspective view taken from a different angle, in which the forming unit is visible in a view from the front lower side.

Returning to the folding unit (100) of the invention, it comprises, as for example shown in FIG. 1 and FIG. 2A, a base structure (1) which has a substantially longitudinal extension, having a first transversal side (11) and a second transversal side (12) and comprising a longitudinal axis (L) and a longitudinal slot (13) which extends from the first transversal side (11) to the second transversal side (12), along the longitudinal axis (L).

The folding unit (100) is suitable for being positionable with the longitudinal axis (L) of the base structure (1) in the infeeding direction (Z) of the continuous sheet (F) so that the base structure (1) can be longitudinally crossed by the continuous sheet (F) of the film material (M) fed in the infeeding direction (Z).

The folding unit (100) also comprises a conveying channel (20), substantially tunnel-shaped, for conveying products to be wrapped according to an advancement direction (V) which longitudinally crosses the base structure (1), and coinciding with the infeeding direction (Z) of the continuous sheet (F), about which a continuous sheet (F) of the film material (M) is to be folded for forming a tubular wrapping (T) during the advancement in the infeeding direction (Z) and the crossing of the base structure (1).

Positioning means (30) of the continuous sheet (F) are present, arranged superiorly of the conveying channel (20) and configured to receive the continuous sheet (F) of film material (M) and to direct the continuous sheet (F) according to the infeeding direction (Z) to longitudinally cross the base structure (1).

Figure 3A:
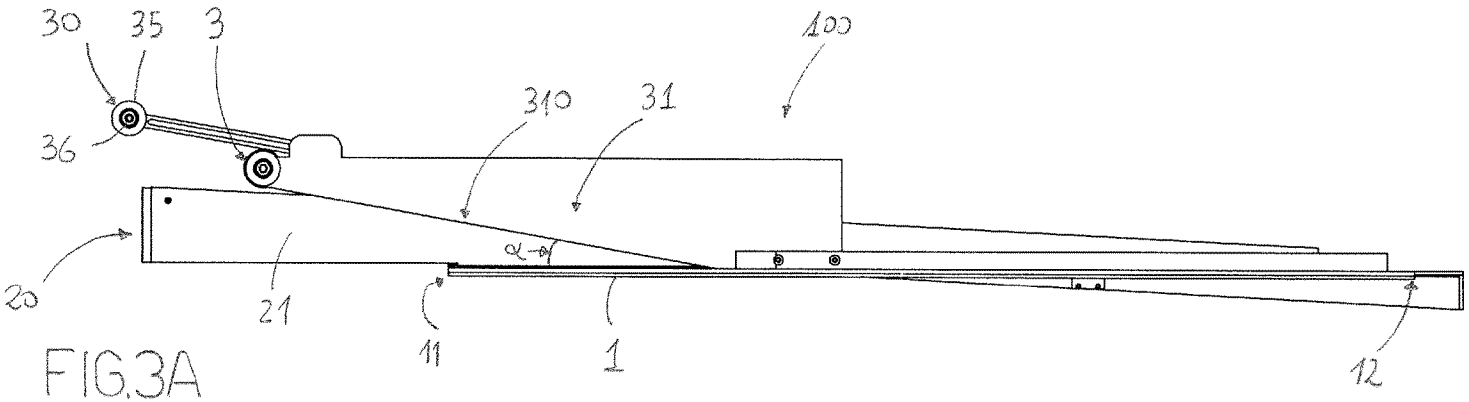
FIG. 3A illustrates the folding unit in a lateral view.
Figure 3B:
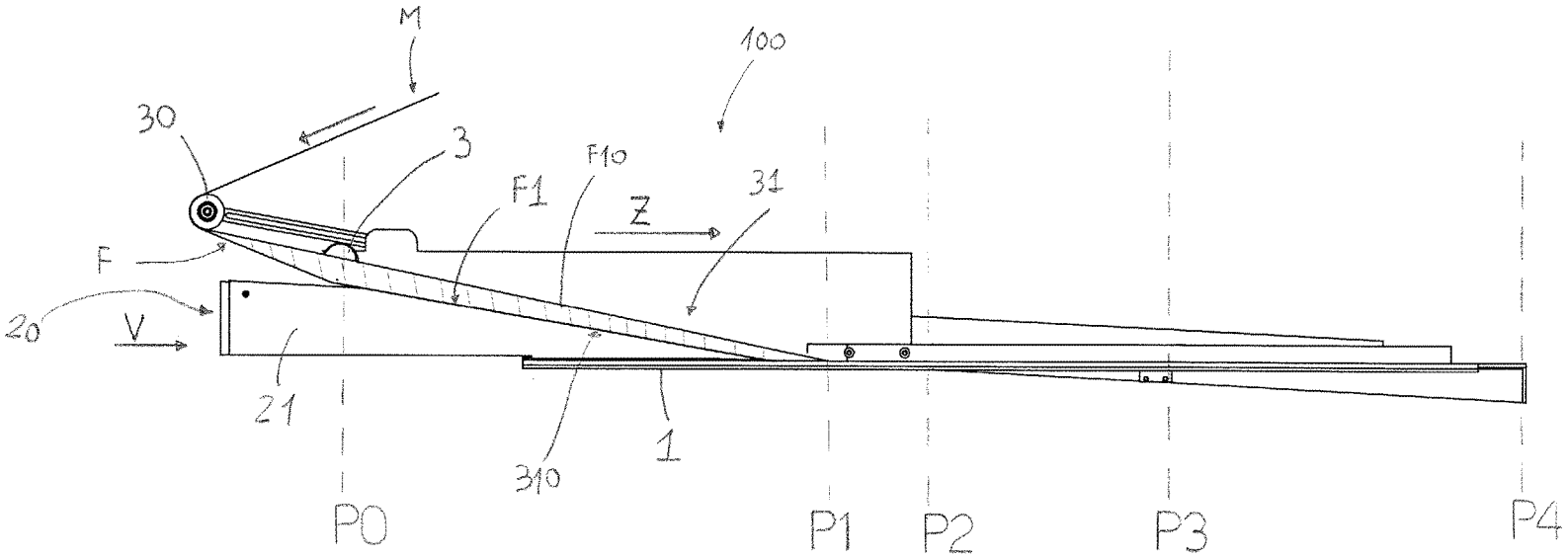
FIG. 3B illustrates the folding unit according to the lateral view of FIG. 3A; in which a continuous sheet of a film material is illustrated during the folding thereof to form a tubular wrapping about products in advancement (not illustrated); this figure also illustrates the folding planes of FIG. 1.
Figure 4A:
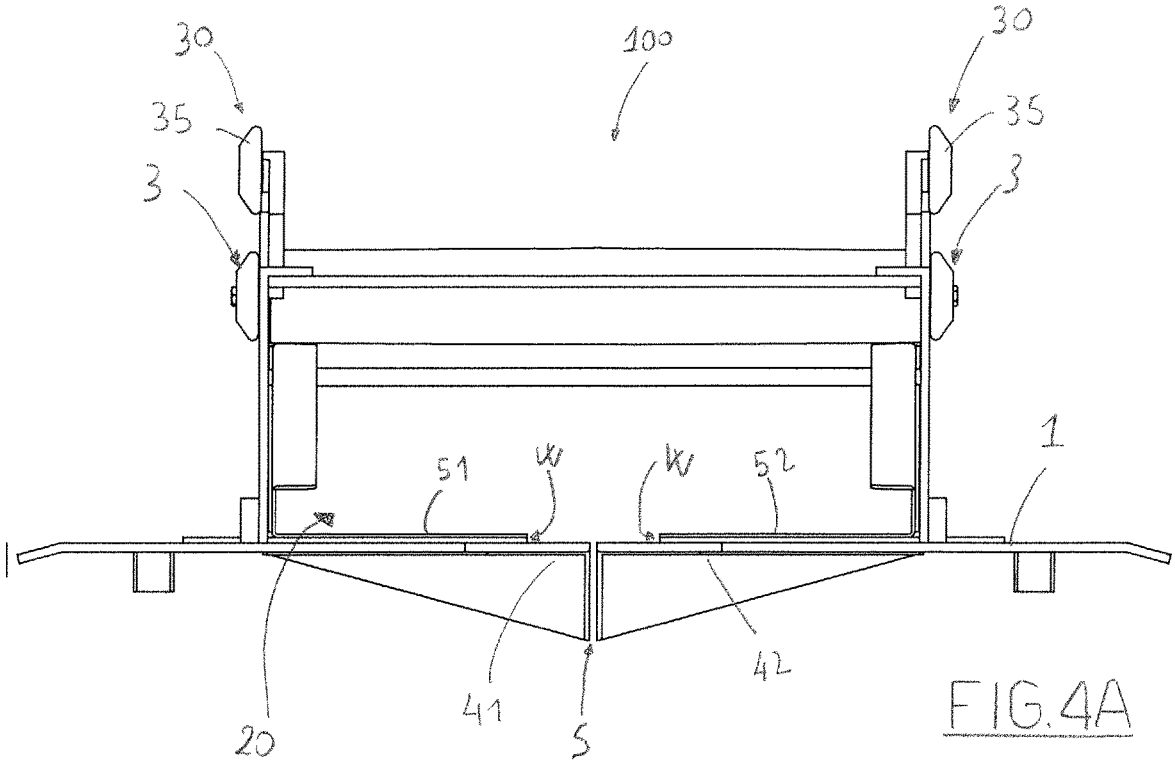
FIG. 4A is a front view of the folding unit.
Figure 4B:
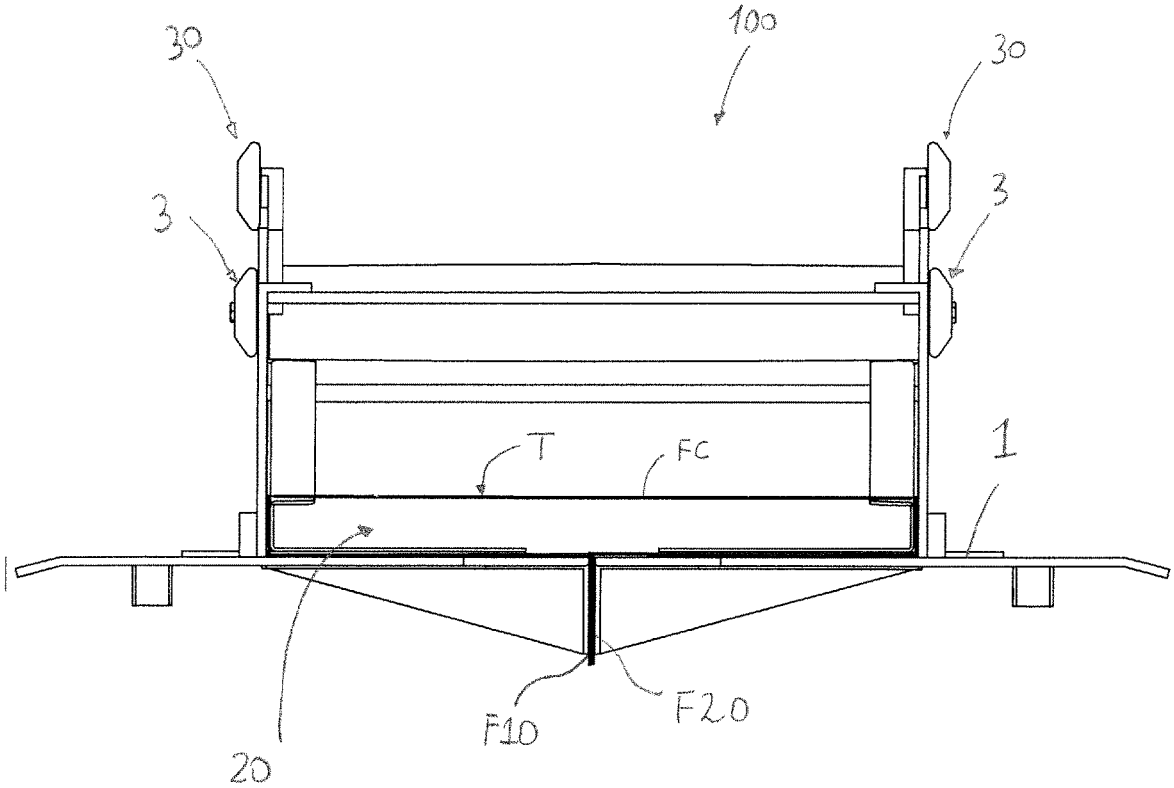
FIG. 4B illustrates the front view of the folding unit of FIG. 4A illustrating a continuous sheet of the film material which has been folded to form a tubular wrapping with the longitudinal end flaps which have been folded and arranged facing one another for the following reciprocal fixing thereof.
Figure 5B:
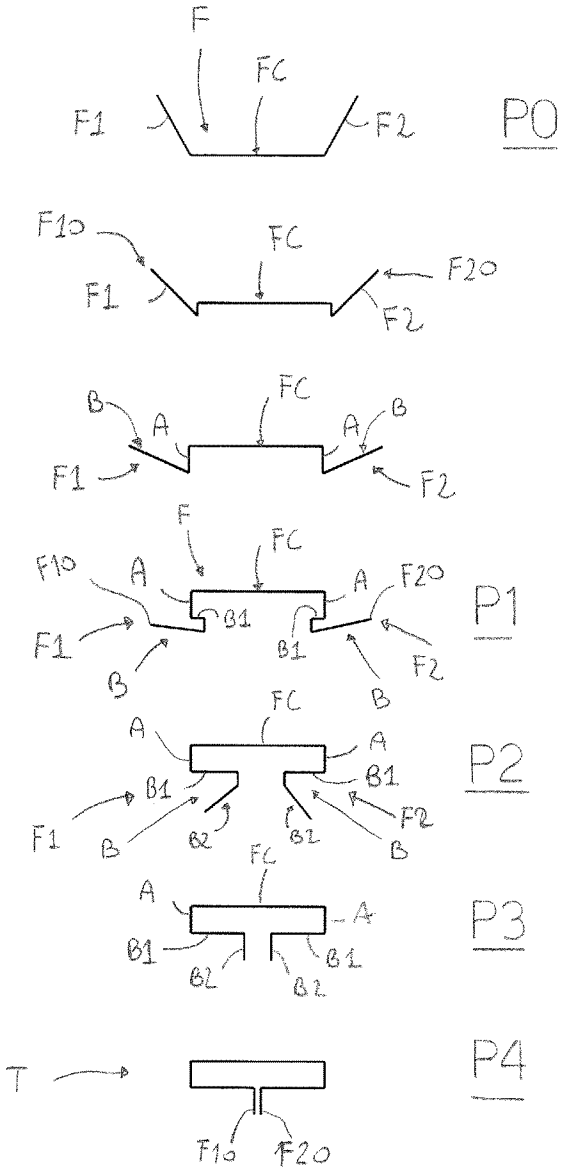
FIG. 5B schematically illustrates a sequence of folding the continuous sheet of the film material across successive folding planes of which some are illustrated in FIG. 1 for forming a tubular wrapping with the longitudinal end flaps which are folded and arranged facing one another for the following reciprocal fixing thereof.
Figure 5A:
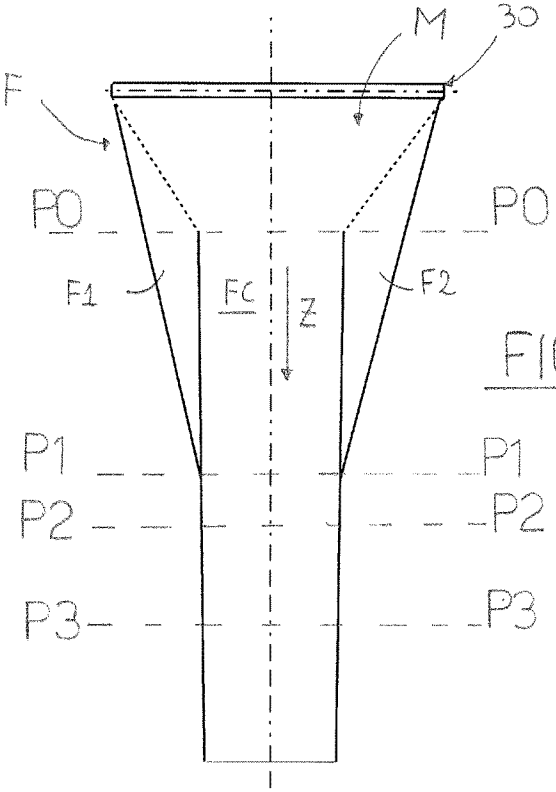
FIG. 5A illustrates schematically illustrates, in a view from above the folding of a continuous sheet of a film material which is carried out by the folding unit of the invention; in this figure too the various folding planes of FIG. 1 are illustrated.

The positioning means (30) are configured and predisposed to arrange the continuous sheet (F) above the conveying channel (20) so as to define a central section (FC) in the continuous sheet (F), above the conveying channel (20), and two lateral sections (F1, F2) having respective end flaps (F10, F20), at the sides of the central section (FC) and at the sides of the conveying channel (20) (see for example the left part of FIG. 3B or the upper part of FIG. 5A).

The special characteristics of the folding unit (100) of the present invention are described in the following and relate to the ways in which it provides the folding of the continuous sheet of the film material, during the advancement thereof across the base structure (1) along the infeeding direction (Z), for forming a tubular wrapping (T) about the products in advancement along the advancement direction (V).

The folding unit (100) comprises a first pair of folding plates (31, 32) (visible for example in FIGS. 2A and 2B, with one thereof being visible in FIGS. 3A and 3B), which are arranged by the sides of the conveying channel (20) and consecutively to the positioning means (30) in the infeeding direction (Z) of the continuous sheet (F).

The plates (31, 32) of the first pair of folding plates (31, 32) are profiled in such a way as to comprise folding edges (310, 320) which are inclined with respect to the base structure (1) and which depart from an upper starting point, situated downstream of the positioning means (30), with respect to the infeeding direction (Z), until reaching a lower arrival point, at the base structure (1).

In particular, according to an entirely special characteristic of the folding unit (100) of the invention, the inclined folding edges (310, 320) of the first pair of folding plates (31, 32) form, with the base structure (1), an angle (α) comprised between 7 and 14 degrees (visible in detail in FIG. 3A) and are configured to abut the two lateral sections (F1, F2) of the continuous sheet (F) and fold them downwards (see FIG. 3B).

Thus, at the starting point of the folding edges (310, 320) of the first pair of plates (31, 32), a first folding plane (P0) is defined, transversal to the base structure (1) and to the longitudinal axis (L) thereof, from which the downwards folding step of the two lateral sections (F1, F2) begins with respect to the central section (FC) of the continuous sheet (F).

The base structure (1) comprises a pair of lateral slots (14, 15) (see for example FIG. 1 or FIGS. 2A and 2B) which are arranged at the sides of the conveying channel (20) and in a zone at the lower arrival points of the folding edges (310, 320) of the first pair of folding plates (31, 32) on the base structure (1).

The pair of lateral slots (14, 15) is conformed so as to enable passage of the lateral sections (F1, F2) of the continuous sheet (F) folded in a downwards direction by the inclined folding edges (310, 320) of the first pair of folding plates (31, 32) in such a way that a first proximal part (A) of the lateral sections (F1, F2) adjacent to the central section (FC), is arranged vertically at the sides of the conveying channel (20) and a second distal part (B) comprising the end longitudinal flaps (F10, F20) del continuous sheet (F) is folded and facing downwards, i.e. inferiorly of the lateral slots (14, 15).

In substance, a second folding plane (P1) (transversal to the base structure (1)) for the continuous sheet (F) can be identified at the position of the pair of lateral slots (14, 15).

The passage of the second distal part (B) of the lateral sections (F1, F2) of the continuous sheet (F) below the conveying channel (20) takes place at the second folding plane (P1), which will then enable, as described in the following, a first portion (B1) of the second distal part (B) to be folded and tucked beneath the products.

The shape acquired by the continuous sheet (F) at the second folding plane (P1) is for example the one schematically illustrated in the fourth image from the top of the sequence of images of FIG. 5B, while a sequence of the downwards folding step of the two lateral sections (F1, F2) of the continuous sheet (F) realised by the inclined folding edges (310, 320) of the first pair of folding plates (31, 32) is illustrated in the first three images of FIG. 5B, from P0 to P1.

Between the first folding plane (P0) and the second folding plane (P1), the inclined folding edges (310, 320) of the first pair of plates (31, 32), with the angle of inclination (α) thereof comprised between 7 and 14 degrees with respect to the base structure (1), carry out a fundamental folding function of the two lateral sections (F1, F2) of the continuous sheet (F) which are folded, with respect to the central section (FC), from a raised position to a lowered position, i.e. folded downwards, and at the same time arranged, with the relative first proximal part (A), vertically and at the sides of the conveying channel (20).

The first proximal parts (A) of the two lateral sections (F1, F2) which are folded downwards and arranged vertically, will constitute the two lateral portions which laterally wrap the product to be packaged in the tubular wrapping which will be formed.

Figure 2B:
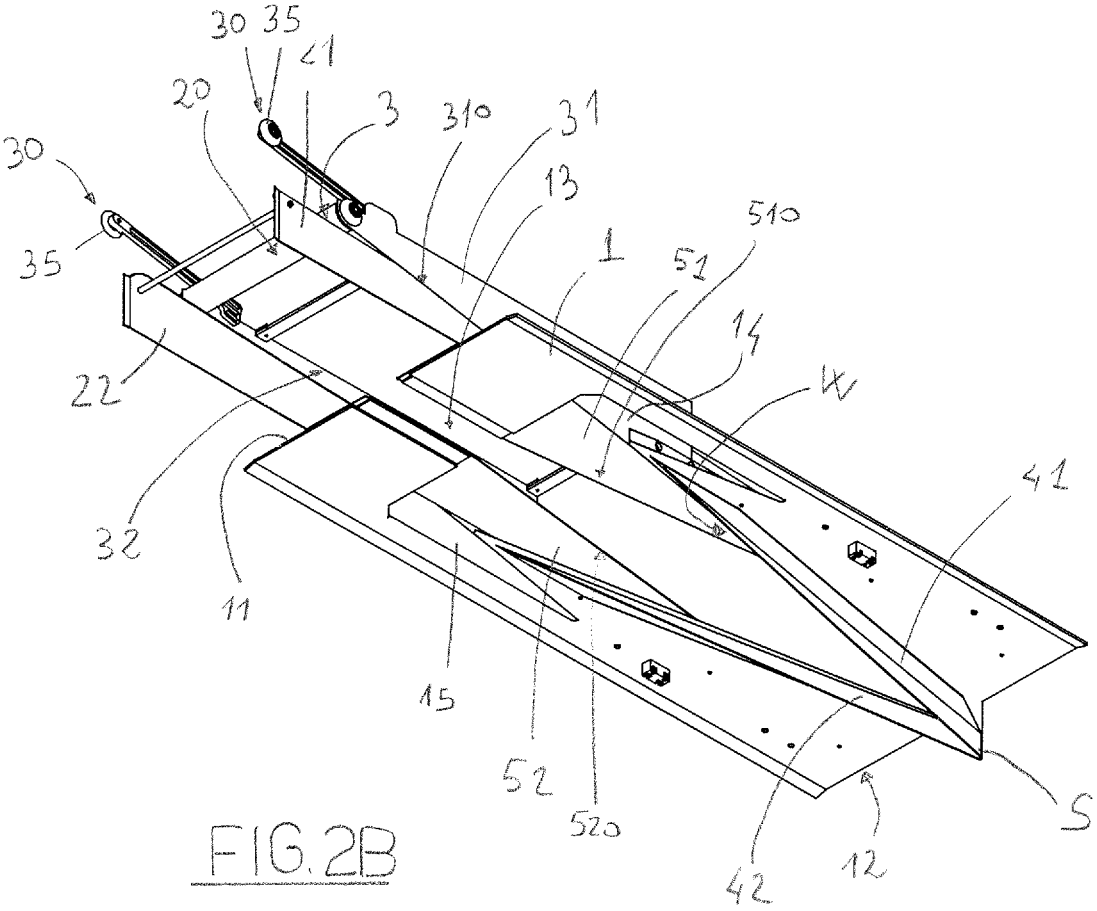

The folding unit (100) further comprises a second pair of folding plates (41, 42), arranged consecutively to the pair of lateral slots (14, 15) in the infeeding direction (Z) of the continuous sheet (F), inferiorly of the conveying channel (20) and on opposite sides with respect to the longitudinal axis (L) and to the longitudinal slot (13) of the base structure (1) (see for example FIG. 1 or FIGS. 2A and 2B).

The plates (41, 42) of the second pair of folding plates (41, 42) are profiled in such a way as to comprise folding edges (410, 420) which are inclined with respect to the longitudinal axis (L) and which extend starting from a starting point in proximity of the pair of lateral slots (14, 15) up to an arrival point in proximity of the longitudinal axis (L); in substance the folding edges (410, 420) have an extension converging towards the longitudinal axis (L).

In greater detail, in a further special characteristic of the folding unit (100) of the invention, the inclined folding edges (410, 420) of the second pair of folding plates (41, 42) form, with the longitudinal axis (L) of the base structure (1), an angle (β) comprised between 7 and 14 degrees (visible in FIG. 1).

The inclined folding edges (410, 420) are configured to abut the second distal part (B) of the two folded lateral sections (F1, F2) of the continuous sheet (F) comprising the end longitudinal flaps (F10, F20) and to fold a first portion (B1) thereof in such a way as to arrange the first portion (B1) opposite the central section (FC) maintaining a second portion (B2) comprising the end flaps (F10, F20) folded downwards, to form a tubular wrapping (T) with the end flaps (F10, F20) facing one another.

Further, the arrival points of the inclined folding edges (410, 420) of the plates (41, 42) of the second pair of folding plates (41, 42) are facing one another in proximity of the longitudinal axis (L) of the base structure (1) defining there-between a passage space (S) for passage of the end flaps (F10, F20) of the tubular wrapping (T) that are facing one another.

The second distal part (B) of the two folded lateral sections (F1, F2) of the continuous sheet (F) comprising the end longitudinal flaps (F10, F20), during the infeeding of the continuous sheet (F) in the infeeding direction (Z) downstream of the second folding plane (P1), will thus encounter the inclined folding edges (410, 420) of the plates (41, 42) of the second pair of plates (41, 42) which will fold it in such a way that a first portion (B1) of the second distal part (B) is arranged opposite the central section (FC) of the continuous sheet (F), maintaining a second portion (B2) of the second distal part (B) comprising the end flaps (F10, F20) folded downwards, to form a tubular wrapping (T) with the end flaps (F10, F20) facing one another.

For example, from the starting points to the arrival points of the inclined folding edges (410, 420) of the plates (41, 42) of the second pair of plates (41, 42), three successive folding planes can be identified (illustrated in FIGS. 1, 3B and 5A with relative broken lines): a third folding plane (P2), a fourth folding plane (P3) and a fifth folding plane (P4) at which, progressively, the first portion (B1) of the second distal part (B) of the two lateral sections (F1, F2) of the continuous sheet (F) is folded so as to be arranged, below the product in advancement along the conveying channel (20), and opposite the upper section (FC) of the continuous sheet, while the second portion (B2) of the second distal part (B) of the two lateral sections (F1, F2) is maintained folded downwards so that the relative end flaps (F10; F20) become arranged facing one another (see for example the sequence of images from P1 to P4 in FIG. 5B).

The last four images of the sequence of images of FIG. 5B schematically illustrate the shape assumed by the continuous sheet (F) at the folding planes (P2, P3 and P4) to form a tubular wrapping (T), about the product (not illustrated) in advancement along the conveying channel (20), with the two end flaps (F10, F20) facing one another and facing and folded downwards.

Lastly, a third further peculiarity of the folding unit (100) is constituted by the fact that it is configured in such a way that the differences between the angle (α), formed by the inclined folding edges (310, 320) of the plates (31, 32) of the first pair of folding plates (31, 32) with the base structure (1), and the angle (β), formed by the inclined folding edges (410, 420) of the plates (41, 42) of the second pair of folding plates (41, 42) with the longitudinal axis (L) of the base structure (1), being comprised between ±2°.

The Applicant has in fact found that the folding unit of the invention, having:

- the inclined folding edges (310, 320) of the first pair of folding plates (31, 32) which form, with the base structure (1), an angle (α) comprised between 7 and 14 degrees;
- the inclined folding edges (410, 420) of the second pair of folding plates (41, 42) which form, with the longitudinal axis (L) of the base structure (1), an angle (β) comprised between 7 and 14 degrees,
- with the difference between angle (α) and angle (β) being comprised between ±2°,
- is able to effectively and precisely carry out, even at high speed, and with no insurgence of ripples or lacerations, the folding of film materials of various types and consistency, in particular of paper materials, single-layer, bio-compostable or biodegradable, as well as the classic plastic materials, aluminium, laminated or coupled, thus overcoming the drawbacks of the folding unit of known type cited in the foregoing.

Other advantageous characteristics of the folding unit (100) of the invention are described in the following.

The folding unit (100) is such that the plates (31, 32) of the first pair of folding plates (31, 32) are arranged vertically with respect to the base structure (1) with the relative inclined folding edges (310, 320) turned downwards.

In a further preferred aspect, the plates (41, 42) of the second pair of folding plates (41, 42) extend downwards, i.e. inferiorly, with respect to the base structure (1), the arrival points of the inclined folding edges (410, 420) being in proximity of the longitudinal axis (L) and projecting beyond the second transversal side (12) of the base structure (1).

The folding unit (100) can be made in such a way as to further comprise a pair of rest plates (51, 52), which are arranged inferiorly of the conveying channel (20) and on opposite sides with respect to the longitudinal axis (L) and to the longitudinal slot (13) of the base structure (1), for the resting and sliding of the products during the advancement thereof internally of the conveying channel (20) and along the advancement direction (V) (see for example FIG. 1 or FIGS. 2A and 2B).

The pair of rest plates (51, 52) are profiled so as to comprise guide edges (510, 520) which are arranged superiorly of the inclined folding edges (410, 420) of the plates (41, 42) of the second pair of folding plates (41, 42), defining there-between a folding space (W) for the folding of the first portion (B1) of the second distal part (B) of the lateral sections (F1, F2) of the continuous sheet (F) below the pair of rest plates (51, 52) and above the plates (41, 42) of the second pair of folding plates (41, 42), so that the first portion (B1) is arranged below the products and opposite the central section (FC) of the sheet during the forming of the wrapping (T).

In particular, the guide edges (510, 520) of the pair of rest plates (51, 52) are profiled in such a way as to have an initial portion (L1) parallel to the longitudinal axis and to the longitudinal slot (13) of the base structure (1), and a second portion (L2) diverging from the longitudinal axis (L).

In this way, the diverging second portion (L2) comprises a crossing point (L3) with the underlying inclined folding edges (410, 420) of the plates (41, 42) of the second pair of folding plates (41, 42) starting from which crossing point (L3) the first portion (B1) of the second distal part (B) of the lateral sections (F1, F2) of the continuous sheet (F) continues to be folded by the inclined folding edges (410, 420) of the second pair of folding plates (41, 42), in order to complete the relative folding thereof and to be arranged opposite the central section (FC), while the second portion (B2) of the second distal part (B) of the lateral sections (F1, F2) with the end flaps (F10, F20) is maintained folded downwards, causing the end flaps (F10, F20) to near one another in order to be arranged facing in the passage space (S) at arrival points of the inclined folding edges (410, 420) of the second pair of folding plates (41, 42) with respect to the base structure (1).

In an advantageous aspect, the positioning means (30) preferably comprise at least a roller (35), or a pair of rollers (35) (as shown in the figures), rotatable about a rotation axis (36) transversal and perpendicular to the infeeding direction (Z) of the continuous sheet (F).

In particular, the roller (35) or pair of rollers (35) is positioned with respect to the base structure (1) in such a way that the rotation axis (36) is arranged along the inclined plane defined by the prolongation of the folding edges (310, 320) of the first pair of folding plates (31, 32).

In another preferred aspect, the folding unit (100) can comprise pre-folding means (3) of the continuous sheet (F), arranged between the positioning means (30) and the first pair of folding plates (31, 32), superiorly of the conveying channel (20) (see for example FIGS. 3A and 3B).

The pre-folding means (3) are configured and predisposed to carry out a pre-folding of the two lateral sections (F1, F2) of the continuous sheet (F) with respect to the central section (FC), by folding the two lateral sections (F1, F2) upwards (see in particular FIG. 3B).

The pre-folding means (3) thus realise a first folding of the continuous sheet which takes place before, i.e. upstream, of the first folding plane (P0).

The way in which the pre-folding means (3) fold the continuous sheet (F) of the film material (M), by folding upwards the two lateral sections (F1, F2) with respect to the central section (FC), upstream of the first folding plane (P0), is for example visible in FIG. 3B or in the upper part of FIG. 5A.

According to the preferred embodiment illustrated in the figures, the pre-folding means (3) comprise a roller or possibly a pair of rollers.

The conveying channel (20) is realised in such a way as to be delimited by at least two lateral walls (21, 22) parallel to one another and borne by the base structure (1).

For example, the conveying channel (20) can be defined by two L-inverted shaped profiled members arranged parallel to one another and borne by the base structure (1).

Lastly, in a further aspect, the folding unit (100) can comprise a pair of welding rollers (81, 82) positioned, for example, downstream of, or inferiorly of, the second transversal side (12) of the base structure (1), bilaterally to the longitudinal axis (L), and arranged in such a way as to be able to abut the end flaps (F10, F20) facing one another of the tubular wrapping (T) in order to carry out the reciprocal welding thereof.

The invention claimed is:

1. A folding unit for folding a film material to form a tubular wrapping, wherein a continuous sheet of the film material, which is to be folded to form a tubular wrapping, is fed according to an infeeding direction, the folding unit comprising:

a base structure having a longitudinal extension, having a first transversal side and a second transversal side and comprising a longitudinal axis and a longitudinal slot which extends, from the first transversal side to the second transversal side, along the longitudinal axis, wherein the folding unit is positionable with the longitudinal axis of the base structure in the infeeding direction of the continuous sheet so that the base structure is longitudinally crossed by the continuous sheet of the film material fed in the infeeding direction;

a conveying channel, for conveying products to be wrapped according to an advancement direction which longitudinally crosses the base structure and coinciding with the infeeding direction of the continuous sheet, about which a continuous sheet of the film material is to be folded for forming a tubular wrapping during the advancement in the infeeding direction and the crossing of the base structure;

positioning means of the continuous sheet, arranged superiorly of the conveying channel and configured to receive the continuous sheet of film material and to direct the continuous sheet according to the infeeding direction to longitudinally cross the base structure, and further configured to arrange the continuous sheet above the conveying channel so as to define a central section in the continuous sheet, above the conveying channel, and two lateral sections having respective end flaps, at the sides of the central section and at the sides of the conveying channel;

a first pair of folding plates, arranged by the sides of the conveying channel and consecutively to the positioning means in the infeeding direction of the continuous sheet, wherein the plates of the first pair of folding plates are profiled in such a way as to comprise folding edges inclined with respect to the base structure and which depart from an upper starting point, situated downstream of the positioning means, down to reaching a lower arrival point, at the base structure, wherein the inclined folding edges of the first pair of folding plates form, with the base structure, an angle comprised between 7 and 14 degrees and are configured to abut the two lateral sections of the continuous sheet and fold them downwards;

wherein the base structure comprises a pair of lateral slots arranged at the sides of the conveying channel and in a zone at the arrival points of the folding edges of the first pair of folding plates on the base structure, the pair of lateral slots being conformed so as to enable passage of the lateral sections of the continuous sheet folded in a downwards direction by the folding edges of the first pair of folding plates in such a way that a first proximal part of the lateral sections adjacent to the central section, is arranged vertically at the sides of the conveying channel;

the folding unit further comprising:

a second pair of folding plates, arranged consecutively to the pair of lateral slots in the infeeding direction of the continuous sheet, inferiorly of the conveying channel and on opposite sides with respect to the longitudinal axis and to the longitudinal slot of the base structure, wherein the plates of the second pair of folding plates are profiled in such a way as to comprise inclined folding edges inclined with respect to the longitudinal axis and which extend starting from a starting point in proximity of the pair of lateral slots up to an arrival point in proximity of the longitudinal axis, wherein the folding edges of the second pair of folding plates form, with the longitudinal axis of the base structure, an angle comprised between 7 and 14 degrees and are configured to abut a second distal part of the folded lateral sections of the continuous sheet comprising the end longitudinal flaps and to fold a first portion thereof in such a way as to arrange the first portion opposite the central section maintaining a second portion comprising the end flaps folded downwards, to form a tubular wrapping with the end flaps facing one another, and wherein the arrival points of the folding edges of the plates of the second pair of folding plates are facing one another in proximity of the longitudinal axis of the base structure defining there-between a passage space for passage of the end flaps of the tubular wrapping that are facing one another;

wherein the difference between the angle, formed by the folding edges of the plates of the first pair of folding plates with the base structure, and the angle, formed by the folding edges of the plates of the second pair of folding plates with the longitudinal axis of the base structure, is comprised between ±2°.

2. The folding unit of claim 1, wherein the plates of the first pair of folding plates are arranged vertically with respect to the base structure with the relative folding edges turned downwards.

3. The folding unit of claim 1, wherein the plates of the second pair of folding plates extend downwards with respect to the base structure, the arrival points of the folding edges being in proximity of the longitudinal axis and projecting beyond the second transversal side of the base structure.

4. The folding unit of claim 1, comprising a pair of rest plates, arranged inferiorly of the conveying channel and on opposite sides with respect to the longitudinal axis and to the longitudinal slot of the base structure, for the resting and sliding of the products during the advancement thereof internally of the conveying channel and along the advancement direction, wherein the pair of rest plates are profiled so as to comprise guide edges which are arranged superiorly of the folding edges of the plates of the second pair of folding plates, defining there-between a folding space for the folding of the first portion of the second distal part of the lateral sections of the continuous sheet below the pair of rest plates and above the plates of the second pair of folding plates, so that the first portion is arranged opposite the central section of the sheet during the forming of the wrapping.

5. The folding unit of claim 4, wherein the guide edges of the pair of rest plates are profiled in such a way as to have an initial portion parallel to the longitudinal axis and to the longitudinal slot of the base structure, and a second portion diverging from the longitudinal axis and which comprises a crossing point with the folding edges of the plates of the second pair of folding plates starting from which the first portion of the second distal part of the lateral sections of the continuous sheet continues to be folded by the folding edges of the second pair of folding plates in order to complete the relative folding thereof and to be arranged opposite the central section while the second portion with the end flaps is maintained folded downwards, causing the end flaps to near one another in order to be arranged facing in the passage space at arrival points of the folding edges of the second pair of folding plates with respect to the base structure.

6. The folding unit of claim 1, wherein the positioning means comprise at least a roller, or a pair of rollers, rotatable about a rotation axis transversal and perpendicular to the advancement direction of the continuous sheet.

7. The folding unit of claim 1, comprising pre-folding means of the continuous sheet, arranged between the positioning means and the first pair of folding plates, superiorly of the conveying channel, and configured to carry out a pre-folding of the two lateral sections of the continuous sheet with respect to the central section, by folding the two lateral sections upwards.

8. The folding unit of claim 7, wherein the pre-folding means comprise a roller or a pair of rollers.

9. The folding unit of claim 1, wherein the conveying channel is delimited by at least two lateral walls parallel to one another and borne by the base structure.

10. The folding unit of claim 9, wherein the conveying channel is defined by two L-inverted shaped profiled members arranged parallel to one another and borne by the base structure.

11. The folding unit of claim 1, comprising a pair of welding rollers positioned downstream of, or inferiorly of, the second transversal side of the base structure, bilaterally to the longitudinal axis, and arranged in such a way as to be able to abut the end flaps facing one another of the tubular wrapping in order to carry out the reciprocal welding thereof.

* * * * *